United States Patent [19]

Larkin

[11] 4,253,610

[45] Mar. 3, 1981

[54] ABRASIVE BLAST NOZZLE

[76] Inventor: Joe M. Larkin, 1117 Guinea, Houston, Tex. 77055

[21] Appl. No.: 73,842

[22] Filed: Sep. 10, 1979

[51] Int. Cl.[3] ..... B24C 5/04

[52] U.S. Cl. ..... 239/430; 51/439; 417/198

[58] Field of Search ..... 239/427.3, 429, 430, 239/433, 591; 51/317, 319, 320, 321, 410, 427, 439; 417/151, 198

[56] References Cited

U.S. PATENT DOCUMENTS

| | | | |
|---|---|---|---|
| 2,387,193 | 10/1945 | Swenarton | 51/439 X |
| 2,717,476 | 9/1955 | Myers | 51/439 |
| 3,424,386 | 1/1969 | Maasberg et al. | 239/429 X |

FOREIGN PATENT DOCUMENTS

| | | | |
|---|---|---|---|
| 663604 | 12/1951 | United Kingdom | 51/439 |

*Primary Examiner*—Andres Kashnikow

*Attorney, Agent, or Firm*—Gunn, Lee & Jackson

[57] ABSTRACT

A modified abrasive blast nozzle is disclosed in the preferred embodiment which incorporates an elongate fitting having threads enabling it to be connected with a hose, an internal axial passage which tapers into a narrow neck and thereafter flares outwardly, the axial passage flaring at an internally located, encircling, water inlet manifold, the manifold being communicated to the axial passage by a number of small openings, and the nozzle body further including an inlet pipe connection for water. Abrasives under high pressure with a high volume of air flows through the axial passage. As it moves past the openings into the manifold, an aspirator effect is achieved which pulls water or other liquids from the aspirator manifold into the outlet flow of air and blasting or abrasive media to thereby moisten the media and surface as needed to prevent formation of a cloud of dust and to neutralize and/or trap any airborne chemical, free silica or contaminants.

4 Claims, 2 Drawing Figures

ABRASIVE BLAST NOZZLE

BACKGROUND OF THE DISCLOSURE

In abrasive blasting, air flowing at a high volume and velocity carries abrasive particles with it. The abrasive particles function as tiny projectiles which chip or abrade a workpiece. The substrate of the workpiece may be worn away by the blast. Abrasive blasting and/or a high pressure mixer can be used to remove scale, rust, corrosion and other materials from a surface. Old or dead paint on a surface can also be removed. It is literally chipped away in tiny pieces by the blast.

Abrasive blast apparatus is fairly old. It is a very successful technique of preparing a metal surface for recoating, for removing rust, etc. The present invention enhances a blast apparatus by suppressing the cloud of dust that is formed.

Abrasive blasting is typically accomplished through the use of graded abrasive particles of a selected composition. The blast particles that are chosen are typically chosen with two factors in view, one being the size of the particles and the other being the physical properties of the particles. For instance, the particles can be screened and thereby selected to obtain large or relatively small blast particles. A selection of particle with many sharp corners created by crushing enhances the abrasive action. The life and durability of the particles is in part determined by the physical properties obtained from various types of abrasives. In the application of abrasive blast to a workpiece, the sand hits it quite sharply, and the particles are often broken. When they are broken, they break into tiny pieces which are generally described as dust. The pieces are quite small, sufficiently small that they can be airborne upwardly, in effect, forming a large cloud of dust. The dust is scattered far and wide as a result of the sideblast from the diverted stream of air associated with blasting. This scatters the dust and keeps it stirred, dissipating it over a wide area and carrying all types of chemicals and particles chiseled from the surface.

The present invention has as one of its objects the reduction of dust dissipation. The dust at least constitutes a health hazard. The cloud of dust requires respirators on operators in many circumstances. It can also create an explosive atmosphere in some instances. It requires suppression through the use of hoods, special enclosures and the like, all of which are very expensive.

With the foregoing problem in view, the present invention has as one object the incorporation of a means which adds water in a controlled quantity to all particles of the sandblast flow. The water is in large part atomized as it flows with the abrasive blast emerging from the nozzle. In any case, it moistens the stream of air which carries the blast particles, and the particles are slightly dampened. It does not impede the performance of the abrasive blasting procedure, itself; it does, however, moisten the dust and cause the dust to settle more rapidly. Indeed, by controlling the rate of flow of water, the dust can be caused to settle along with the heavier particles reboudning from the workpiece.

One advantage of the present invention is the ability of the water to carry waterborne inhibitors. Rust, neutralizers and oxidation inhibitors can be added to the water and thereby introduced into the blast media stream. This can be beneficial either to the rebounding blast particles or to the surface of the workpiece, depending on the requirements. As an example, the induction of water soluble inhibitors, coupled with the electrostatic charging of particles in the abrasive blast nozzle, can place an ion-attached inhibitor coating on the workpiece.

Another feature of the present invention is the extent of mixing. In particular, mixing is achieved in the nozzle, itself. Mixing is in large part dependent on scale factors, including the length of the nozzle, the position of the manifold, the ports which introduce water, the flow rate and the like. The turbulence that occurs within the nozzle is in large part dependent on the design of the nozzle. Through the use of design factors which yield a high turbulence mixing in the nozzle, it is possible to accomplish good dispersion of the blast particles through the nozzle and also to disperse the water that is introduced. In light of the high flow rates which occur, it is possible to obtain turbulence with a Reynolds number of 250,000 and up. This thoroughly wets each blast particle which flows through the nozzle and will fairly well moisten the blanket of moving air which carries the particles. The homogenizer effect can be accomplished at much less cost than present types.

One advantage of the apparatus of this disclosure is the incorporation of a valve means which varies the flow of water. The flow of water can be tailored to meet specific needs. For example, the device may not need water at times when the air pump is inoperative and, yet, no particles are introduced into the stream of air.

BRIEF DESCRIPTION OF THE DISCLOSURE

The above mentioned advantages are among the features found in this apparatus, the apparatus being briefly summarized as a modified abrasive blast nozzle. It has an elongate body shaped like a nozzle with a hollow, axial passage. It is threaded at both ends to enable attachment to a hose and an in-line mixer. The nozzle incorporates a large, funnel-shaped, axial passage which narrows to a neck and which flares outwardly to the end of the nozzle. The nozzle further includes an internal manifold connected through a lateral passage for delivery of water flowing through a valve. The manifold encircles the axial passage and is positioned near to it. The manifold is drilled with a number of small openings which open into the axial passage which open at a shoulder which faces downstream, not upstream. As water flows through the nozzle, it creates an aspirating action which draws water from the manifold and which aspiration tends to atomize it. The water is distributed by turbulence through the stream of air flowing from the apparatus, and the water eventually comingles with the abrasive blast particles. It is constructed and arranged to obtain high turbulence and the consequential mixing of water in the abrasive blast.

DETAILED DESCRIPTION OF THE DISCLOSURE

Figure 1:
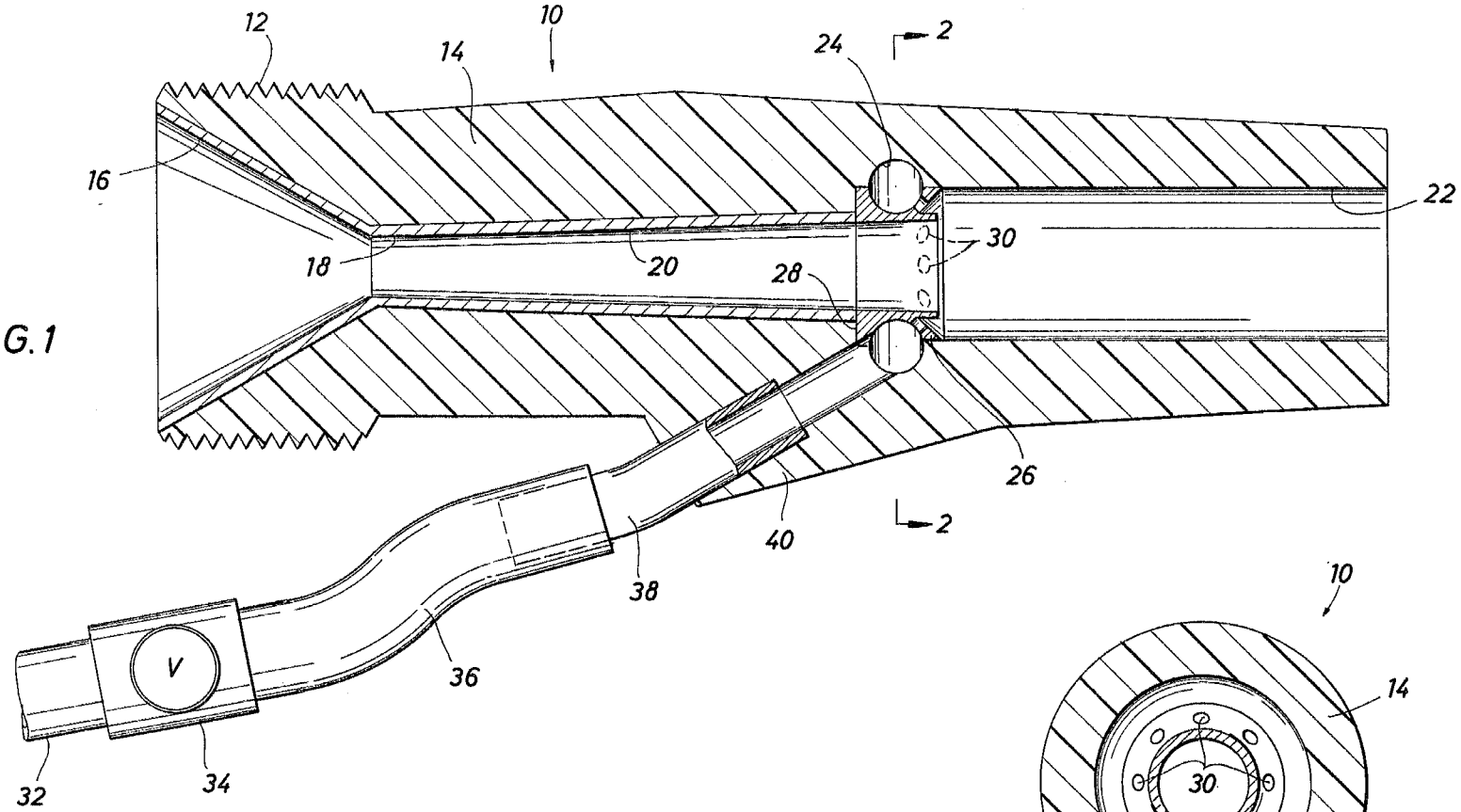
FIG. 1 is a sectional view through the improved abrasive blast nozzle of the present invention.
Figure 2:
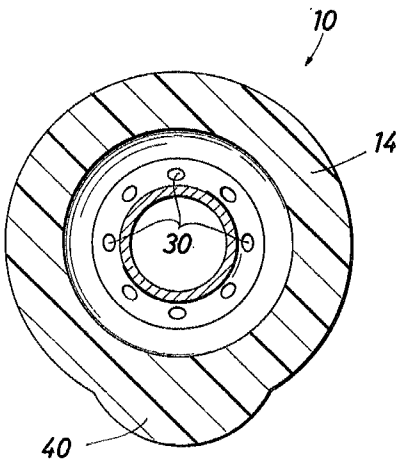
FIG. 2 is a sectional view along the line 2—2 of FIG. 1 of the drawings.

Attention is first directed to FIG. 1 of the drawings where the numeral 10 identifies the improved nozzle of the present invention. The nozzle includes a set of threads at 12 formed on a body 14 which is elongate and generally cylindrical in construction. Threads at the opposite end are optionally included. The threads 12 are formed at one end to enable connection to a hose which delivers air and abrasive blast material through the hose into the nozzle. The nozzle incorporates an internal, axial passage which begins with a large, funnel-shaped transition portion at 16. The portion 16 opens from a large or wide mouth to a small and narrow diameter at 18 which is reduced in size. This forces the air and abrasive flowing through the nozzle to accelerate and achieves tremendous velocity of the abrasive blast particles as required. It will be observed that the axial passage flares slightly at the portion 20. The portion 18 is at the entrance of the central, narrow passage and flares by forming a larger passage through the body. As the passage flares slightly, the lateral pressure experienced by the wall is reduced dependent on the rate of flow, the cross-sectional area and other factors. The body 14 surrounds and defines the passage 20, and it is ideally formed as a single piece, thereby avoiding seams in the passage which might be abraded by the abrasive material flowing through the nozzle 10.

Typical construction of a nozzle utilizes tungsten carbide adjacent to the flow of abrasive blast material. Tungsten carbide particles embedded in a softer matrix of supporting alloy metal define the portion of the nozzle adjacent to the axial flow passage. The outer body surrounding the tungsten carbide insert can be formed of a softer material such as molded polyurethane. As a suggestion, and with regard to the preferred embodiment, the ideal nozzle construction utilizes a centered liner formed of tungsten carbide particles supported in a matrix of a softer alloy metal. It has a thickness of about 1.0 centimeters or less and a hardness which is typical of tungsten carbide particles, it being kept in mind that the particles, themselves, are supported in an alloy metal matrix. The alloy metal may, in fact, have a distinctly reduced structural resistance to abrasion; the tungsten carbide particles certainly provide this even if the supportive alloy metal does not. Alternatively, boron can also be used in an alloy or composite nozzle. The tungsten carbide measures a hardness of 80 as tested on the Rockwell C standard. A maximum useable value is about 90 on the same scale. Lesser values of hardness can be achieved if long nozzle life is not desired.

The remainder of the body shown in FIG. 1 can be formed on the exterior of molded polyurethane or a softer metal such as molded aluminum. On the use of a molded, thermoplastic material, a suitable bond is made between the material, itself, and the tungsten carbide insert. As will be understood, the choice of materials depends in part on the toughness of the abrasive media. It also depends in part on the cost of the apparatus to be formed into the present invention.

The present invention includes an outlet passage at 22 which is concentric with and an extension on the central passage 20. It will be observed to be larger, the increase in diameter initiating some agitation of the products flowing through it, thereby increasing the turbulence and mixing that occurs in the nozzle.

As internal conduit 24 is positioned within the body 14 and is formed in the solid body by undercutting to form an encircling ring or manifold. The passage 24 is fully circular and is spaced from the passage 20. The passage 24 is thus defined by forming an encircling, enlarged passage within the body 14 and is completed by positioning a removable insert 26. The insert 26 seats against a shoulder 28 shown in FIG. 1. The insert 26 is preferably formed of hardened plastic material which is somewhat resilient. It jams into the passage 22 which is of right cylindrical construction and seats against the shoulder 28. The insert 26 has an outer face which is encircled by a groove to mate with the nozzle body 14, thereby defining a closed, encircling passage. The passage 24 thus serves as a manifold when the insert is positioned as shown in FIG. 1.

It will be observed that the insert 26 includes an axial passage which is aligned with the passage 20. It is an extension to the passage 20. It then flares to a larger diameter to make the transition to the passage 22. As the diameter is increased, the air and particle blast moving through the nozzle 10 is permitted to expand to fill the increased diameter of the passage 22 and flows to the very end of the apparatus. The insert 26 further incorporates a number of small ports or passages 30 which are spaced around the insert and extend radially from the face where they exit to the passage 24. The insert 26 has a cylindrical overhang to extend slightly past or over the many parts 30. The overhang shelters the ports 30 to direct the flow downstream and aspirates water flow. They enable aspiration flow of water into the blast stream, itself. Description of its operation will expand understanding of its operation.

The insert 26 forms an abrupt step which causes a downstream expansion of air flow and a consequential lateral pressure drop which pulls water into the axial passage. The step need not be a sharp, abrupt step; an expansion chamber will suffice. It is convenient that the parts face the nozzle outlet so that vacuum flow of wetting fluid occurs.

The numeral 32 identifies a water line which is connected to a valve 34 which, in turn, connects with another line 36. Water in a controlled quantity flows through the lines just mentioned and is delivered to an inlet port 38 which has the preferred form of a bent tubular member protruding from an enlargement 40 affixed to the nozzle. The enlargement 40 fairs the laterally directed elbow 38 into the axial passage for connection with the encircling manifold 24. Water is introduced into the manifold 24 at a controlled rate and is delivered to the abrasive blast in like fashion. The delivery mechanism, however, does not rely on a valve as such; rather, water is aspirated from the manifold 24 and introduced into the passage 22. For predictable flow rates, a pressure regulator smooths flow variations so that the water flow into the airstream is predictable and primarily variable with the aspirating force.

The foregoing discloses and describes the structure of the present apparatus. Its operation will become more readily apparent from the consideration of the description included below.

In operation, the modified abrasive blast nozzle 10 of the present invention is used by installing it on a hose which delivers a high volume of air flow with blast particles entrained in the air flow. The nozzle is affixed by using the threads 12. Through the use of control means regulating the rate of flow, the nozzle can be used to abrasive blast a workpiece. The present invention uses the features described heretofore which enable water, either pure or laden with selected inhibitors, to be atomized and blown against the workpiece. Water flows through the valve 34 at a rate determined by the setting of the valve and flows into the manifold 24. The manifold 24, being at least partially filled with water, distributes the water around the stream flowing from the nozzle.

Air introduced through the nozzle creates aspiration forces at the openings 30 which literally draws water through the openings. Depending on the rate of flow and other scale factors, the water is atomized and is distributed throughout the stream, being adequately mixed by the turbulence that occurs in the nozzle. Pure water can be used; in the alternative, ionized water can be used. It will be appreciated that static electricity charges build up on the particles that flow through the abrasive blast nozzle 14. Through the use of ionized water, the water particles can be made to cling to the abrasive particles. Alternately, the water can be ionized so that it will cling to the workpiece, itself. The water additionally may include coating materials such as rust inhibitors, oxide preventive materials and the like. They are dissolved in the water flow and are distributed onto the workpiece with the blast of air flowing through the nozzle. The present invention draws water proportionately to the aspirating force. If the force is zero, the wetting fluid flow rate is reduced. As the aspirating force increases with the air velocity, the wetting fluid flows at an increased rate. The minimum flow rate of wetting fluid is determined by its supply pressure.

As a scale factor, the present invention can be used in a typical industrial job where the rate of abrasive flow material is about 1100 pounds per hour. It can be used with standard size particles which are measured in grit sizes of No. 1 to No. 5. It can also be used with other types and sizes of grit or blast particles. Typically, a relatively small volume of water is required because it is so thoroughly mixed and atomized. Flow rates in the range of about 25.0 to 50.0 gallons per hour will prove sufficient in many industrial applications to wet the particles and thereby reduce or eliminate the cloud of dust that occurs on operation. Ordinarily, water is the preferred media; other liquids can be used with or without water.

It will be observed that the present invention utilizes the funnel-shaped portion at 16 to serve as a venturi compression passage. This increases the rate or velocity at which the air and abrasive media move through the nozzle. The narrow diameter at 18 initiates maximum velocity. The stream expands somewhat downstream, thereby initiating the reduction in lateral pressure which is enhanced at the transition in diameters at the openings 30, thereby inducting water into the stream of air.

While the foregoing is directed to the preferred embodiment, the scope of the present invention is determined by the claims which follow.

I claim:

1. An improved air blast nozzle which comprises:

(a) an elongate nozzle body having an elongate, axial passage therethrough which passage has an inlet and an outlet;

(b) means for joining said nozzle body to a hose at the inlet of said passage to introduce blast media and air flow through the elongate, axial passage;

(c) said passage and said nozzle body being constructed and arranged to create a laterally directed aspirating force within said axial passage, said nozzle body including a funnel-shaped portion in said axial passage which serves as a compression venturi to increase the rate of flow of air and particle media flowing through said axial passage which is located upstream of said aspirator force, said funnel-shaped portion further including an axial portion extending therefrom which flares slightly for reducing the lateral aspirating force exerted on the inner walls of the axial passage;

(d) a manifold means for receiving a wetting fluid therein, said manifold means extending about the elongate passage through said nozzle body and further including port means opening from said manifold means into said axial passage to permit wetting fluid to flow into said axial passage at the urging of the aspirating force acting thereon, and further including subsequent length of said axial passage to the outlet thereof in which length wetting fluid introduced into said axial passage is dispersed into the stream of air and blast media flowing through said passage.

2. The apparatus of claim 1 wherein said axial passage is formed with an internal step enlarging the diameter thereof and further locating said port means at said step facing the outlet of said axial passage for aspirating wetting fluid from said manifold means into said axial passage.

3. The apparatus of claim 2 wherein said step represents an abrupt transition in diameter of said axial passage and said transition is formed by the incorporation in said body of an encircling manifold cavity which is communicated to the exterior for connection with a source of a wetting fluid supplied through a lateral passage means and connected valve means and wherein said manifold means includes an insert located within said manifold cavity and has a finite number of individual port means opening into said axial passage.

4. The apparatus of claim 3 wherein said abrupt transition is formed at an angled insert having the form of a hollow insert fitting within said axial passage from said outlet thereof.

* * * * *